United States Patent [19]

Ferronniere

[11] Patent Number: 4,640,217

[45] Date of Patent: Feb. 3, 1987

[54] PNEUMATIC BOATS

[75] Inventor: Michel Ferronniere, Paris, France

[73] Assignee: Zodiac, Issy les Moulineaux, France

[21] Appl. No.: 769,810

[22] Filed: Aug. 28, 1985

Related U.S. Application Data

[63] Continuation of Ser. No. 399,299, Jul. 19, 1982, abandoned.

[30] Foreign Application Priority Data

Jul. 22, 1981 [FR] France ..... 81 14294

[51] Int. Cl.[4] ..... B63B 7/08

[52] U.S. Cl. ..... 114/345; 441/40

[58] Field of Search ..... 114/345, 61, 40

[56] References Cited

FOREIGN PATENT DOCUMENTS

| | | | |
|---|---|---|---|
| 1964508 | 7/1971 | Fed. Rep. of Germany | 114/61 |
| 2339379 | 2/1975 | Fed. Rep. of Germany | 114/345 |
| 1964656 | 10/1977 | Fed. Rep. of Germany | 114/345 |
| 1380674 | 10/1964 | France | 114/345 |
| 2422135 | 12/1979 | France | 114/345 |
| 2001586 | 2/1979 | United Kingdom | 114/345 |

*Primary Examiner*—Sherman D. Basinger
*Assistant Examiner*—Thomas J. Brahan
*Attorney, Agent, or Firm*—Larson and Taylor

[57] ABSTRACT

The boat comprises in combination two lateral canvases (8) disposed tangentially to the two compartments (6,7), and a bottom canvas (11) held under tension by a longitudinal keel (9) interposed between a floor (10) and said bottom canvas (11).

16 Claims, 4 Drawing Figures

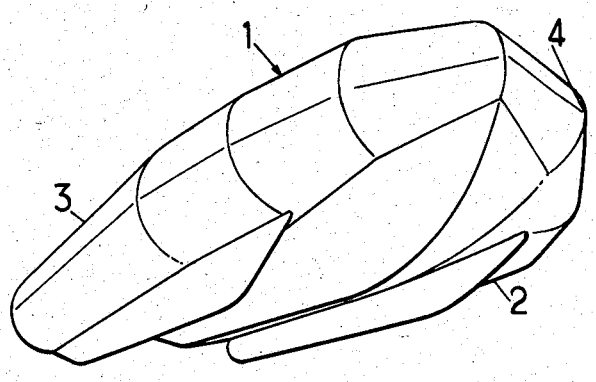
FIG.1.
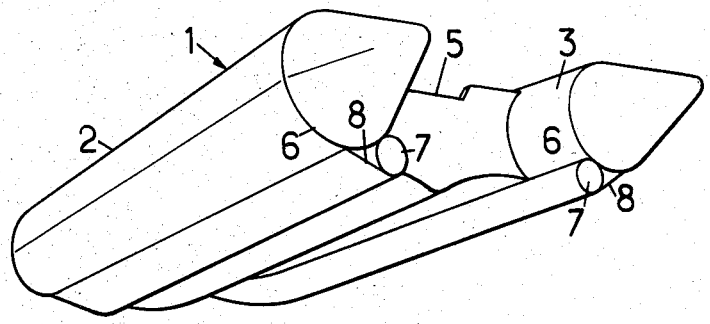
FIG.2.
FIG.3.
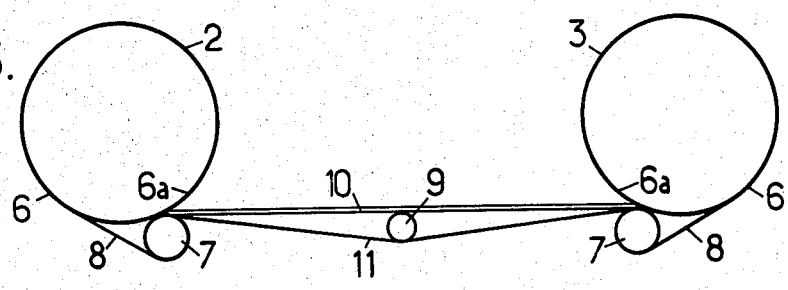
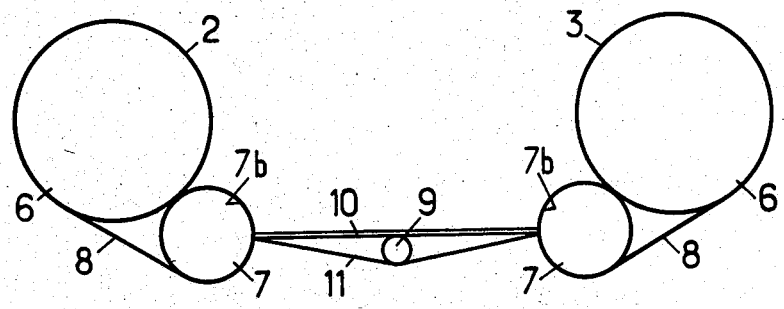
FIG.4.

PNEUMATIC BOATS

This application is a continuation of application Ser. No. 399,299 filed July 19, 1982 now abandoned.

The invention relates to pneumatic boats comprising at least one inflatable tube forming two parallel or substantially parallel legs joined together at the front to form a stem and a rear board connecting these two legs together and intended to receive or to house at least a motor.

It has already been proposed to construct such boats by having recourse to the arrangement in which each of the two legs comprises, at least in its parallel or substantially parallel parts, a lower compartment and an upper compartment, each circular or substantially circular in cross-section and fixed to one another along a circumferential zone, the upper compartment having a cross section greater than that of the lower compartment.

In a boat of this type, a lateral canvas is provided fixed tangentially to the two upper and lower compartments and situated on the outer side of the leg considered; the dimensions of these two upper and lower compartments are in this case chosen so that the angle formed by the lateral canvas and the horizontal plane is between 5° and 45°.

A boat is then provided which has very advantageous characteristics of navigability at high speeds (comfort, holding a course, ease of lifting off the water), but which, at low or average speeds, poses problems of adaptation of immersion of the propellor.

In fact, when the boat has lifted off the water, the rear board is relatively high on the water, which leads to adopting a certain adjustment in the position of the motor on the rear board corresponding to correct immersion of the propellor for rapid navigation in the lifted configuration of the boat.

On the other hand, at low or average speeds, the rear of the boat, and so the rear board, is much lower on the water than in the lifted-off configuration: under these conditions, immersion of the propellor risks therefore being too great, which adversely affects the efficiency of the boat.

The invention has precisely as its aim to avoid this drawback by proposing a boat in which the height of the rear board over the water varies much less than in the case of the above-described boat.

The invention has further aims, particularly to provide a boat whose qualities of comfort and sailability are as constant as possible whatever the speed of use of the boat, to provide a boat capable of carrying high useful loads and in a lifted-off configuration, i.e. at high speed and with optimum efficiency.

According to the invention the boat comprises at least one inflatable tube forming two parallel or substantially parallel legs joined together at the front to form a stem and a rear board connecting these two legs together and intended to receive or house at least a motor, each of these two legs comprising, at least in its parallel or substantially parallel part, an upper compartment and a lower compartment, each circular or substantially circular in cross section, and fixed to one another along a circumferential zone, the upper compartment having a cross section greater than that of the lower compartment, a lateral canvas being fixed tangentially to these two upper and lower compartments on the outer side of the leg considered, these two compartments being dimensioned and disposed with respect to one another so that the mean angle formed by this lateral canvas and the horizontal plane is between 5° and 45°, and it is characterized by the fact that it further comprises a longitudinal keel interposed between a floor, rigid in the transverse direction, which is held in position along the length of the two legs of the boat and a bottom canvas which is connected to the peripheral edges of said floor.

According to an advantageous embodiment of the invention, the rigid floor is held supported on the lower face of the upper compartment forming each of the two legs of the tube of the boat, and the bottom canvas is fixed to the two legs of the tube of the boat at the level of the connection between the upper and lower compartments forming each of said two legs.

Preferably, the keel, interposed between the rigid floor and the bottom canvas is a pneumatic keel formed by at least one elongate inflatable enclosure.

With the arrangement of the invention, a boat is obtained whose hydrodynamic qualities at high speed are due, for a large part, to the lift surfaces offered by the two lateral canvases and whose hydrodynamic qualities at low or average speeds are due, for a large part, to the lift surfaces offered by the bottom canvas.

The height of the rear board above the water varies then in smaller proportions than for a boat only having, as lift surfaces, the lateral canvases. An adjustment may then be adopted for the position of the motor on the rear board which corresponds to correct immersion of the propeller, not only for rapid sailing in the lifted-off configuration of the boat but also for sailing at low or average speeds for which the boat behaves like a displacement hull.

It will also be readily understood that, through a judicious choice of the respective dimensions of the upper and lower compartments, the inclination of the two lateral canvases with respect to the horizontal plane, the inclination of the bottom canvas with respect to the horizontal plane, it is possible to provide a boat whose qualities of comfort and sailability are as constant as possible whatever the speed in use of the boat.

In addition, still with reference to the possibilities allowed by this choice, it is possible to provide a boat capable of carrying large useful loads in a lifted-off configuration, i.e. at high speed and with optimum efficiency.

The invention consists, apart from the arrangements which have just been discussed above, of certain other arrangements which are preferably used at the same time and which will be more explicitly considered hereafter.

The invention will, in any case, be well understood with the complement of description which follows and the accompanying drawings, which complement and drawings are relative to a preferred embodiment of the invention and comprise, of course, no limiting character.

FIG. 1 of these drawings is a bottom perspective view, seen from the bow of the boat in accordance with the invention;

FIG. 2 is a bottom perspective view seen from the stern of the boat in accordance with the invention;

FIG. 3 is a cross section of the boat shown in FIGS. 1 and 2; and

FIG. 4 is a cross section showing a boat constructed in accordance with a variation of the invention.

As shown in FIGS. 1 to 3, the boat comprises an inflatable tube 1 forming two legs 2 and 3 which are parallel or substantially parallel and which are joined towards the front to form a stem 4.

A rear board 5 connects these two legs 2 and 3 together and is intended to receive or to house at least a motor, not shown in these figures, and which may be advantageously formed by a motor of the outboard motor type.

Each of these two legs 2 and 3 comprises, at least in its parallel or substantially parallel part, an upper compartment 6 and a lower compartment 7, each circular or substantially circular in cross section.

These two upper 6 and lower 7 compartments are fixed to each other by any appropriate means (more especially by bonding) along a circumferential zone.

The upper compartment 6 has a cross section greater than that of the lower compartment 7.

A lateral canvas 8 is fixed tangentially to these two upper 6 and lower 7 compartments on the outer side of the leg 2 or 3 considered.

The two upper 6 and lower 7 compartments of each leg 2 or 3 are dimensioned and disposed with respect to one another so that the mean angle formed by this lateral canvas 8 and the horizontal plane is between 5° and 45°.

The boat further comprises a longitudinal keel 9 interposed between a floor 10, rigid in the transverse direction, which is held in place along the two legs 2 and 3 of the boat, and a bottom canvas 11 which is connected to the peripheral edges of said floor.

According to the embodiment of the invention illustrated in FIGS. 1 to 3, the rigid floor 10 is held supported on the lower face 6*a* of the lower compartment 6 and the bottom canvas 11 is fixed to the two legs 2 and 3 of the tube 1 of the boat at the level of the connection between the upper 6 and lower 7 compartments forming each of said two legs 2 or 3.

Preferably, the keel 9, interposed between the rigid floor 10 and the bottom canvas 11, is a pneumatic keel formed by at least one elongate inflatable enclosure.

From the constructional point of view, it should be pointed out that the lower compartment 7 of each leg 2 or 3 extends solely along the parallel parts of the two legs 2 and 3.

Referring now to a variation of the invention which is illustrated in FIG. 4, the rigid floor 10 is fixed to the inner face 7*b* of the lower compartment 7 and the bottom canvas 11 may then be fixed to the peripheral edges of floor 10.

It should be noted that the solution illustrated in FIGS. 1 to 3 is more particularly suitable for a pleasure boat of average size in which the angles of the bottom canvases will be chosen so as to offer maximum comfort in use.

As for the solution illustrated in FIG. 4, it is more particularly suitable for a boat of large size and high carrying capacity: the diameters of the upper and lower compartments guarantee great rigidity and the angles of the bottom canvas are chosen so as to offer maximum lift.

In so far as the mean angle is concerned between the lateral canvas and the horizontal plane, it is advantageously between 5° and 25°.

As far as the mean angle is concerned formed by the bottom canvas and the horizontal plane, a value close to 15° may be advantageously chosen.

Finally, the advantages provided by the present invention are the following:

a boat is obtained whose hydrodynamic qualities at high speed, are due, to a large extent, to the lift surfaces formed by the two lateral canvases 8 and whose hydrodynamic qualities at low or average speeds are due, to a large extent, to the lift surfaces formed by the bottom canvas 11;

the height of the rear board 5 over the water varies in much smaller proportions than for a boat which has, as lift surfaces, solely lateral canvases; an adjustment of the position of the motor on the rear board 5 may then be adopted which corresponds to correct immersion of the propellor not only for rapid sailing in the lifted-off configuration of the boat but also for sailing at low or average speeds at which the boat behaves like a displacement hull;

by a judicious choice of the respective dimensions of the upper 6 and lower 7 compartments, of the inclination of the lateral canvases 8 with respect to the horizontal plane, of the inclination of the bottom canvas 11 with respect to the horizontal plane, it is possible to provide a boat whose qualities of comfort and sailability are practically constant whatever the speed of the boat in use;

in addition, still due to the possibilities offered by this choice, it is possible to construct a boat capable of carrying high useful loads in a lifted-off configuration, i.e. at high speed and with optimum efficiency;

the body of the boat thus constructed is of the trimaran type and has therefore damping qualities superior to those of a boat which only comprises lateral canvases or a bottom canvas;

the body of the boat presents a deep "V" shape which results in improving the behaviour during sailing, particularly in so far as comfort is concerned;

the two lower compartments 7 give great rigidity to the boat and, in particular, give great rigidity to the lateral canvases 8 on which a high lift force is exerted, these two lateral canvases 8 being able to provide a guiding effect for the boat, which confers thereon very stable handling and steering capabilities;

when the boat is sailing in a choppy sea, the body is then completely lifted off at the front while resting on the lateral canvases 8 and the bottom canvas 11 so as to chop the crests of the waves and thus smooth the surface of the water;

in a tight turn, the boat undergoes no slide-slipping and no cavitation for it bears on a lower compartment 7 and the lateral canvas 8 situated on the outside;

when the boat is pulling a skier, holding of the course is excellent because of the guiding effect provided by the two lateral canvases 8 and by the bottom canvas 11.

I claim:

1. An inflatable boat comprising two inflatable elongate legs drawing together at corresponding first ends thereof to form a bow portion of the boat, each leg comprised of a first part that is at least substantially parallel with the first part of the other leg and a second part which is connected with the corresponding second part of the other leg to form a part of said bow, each first part comprised of an upper compartment and of a lower compartment each said upper and lower compartments having at least a substantially circular cross section and fixed to the other compartment along a circumferential zone, said upper compartment having a cross section greater than the cross section of said lower compartment;

a rearwardly located transom connecting the other ends of said two legs together, said transom being adapted to receive a motor;

a lateral sheet fixed tangentially to said two upper and lower compartments on the outer sides of each leg; said upper and lower compartments of each leg being dimensioned and disposed with respect to each other so that the angle formed by said lateral sheet and the horizontal plane is between 5° and 45°;

a floor rigid in the transverse direction and engaging the lower face of said upper compartment;

a bottom sheet fixed to said legs at the connection between the upper and lower compartments of said legs;

and a keel interposed between said floor and said bottom sheet, the diameters and size of said lower compartments being such that said bottom sheet contacts the water when said boat is floating.

2. A boat as claimed in claim 1 in which the angle formed by said lateral sheet and the horizontal plane is between 5° and 25°.

3. A boat according to claim 2 in which the angle formed by said bottom sheet and a horizontal plane is close to 15°.

4. A boat according to claim 1 in which the angle formed by said bottom sheet and a horizontal plane is close to 15°.

5. A boat as claimed in claim 1 wherein each of said two lower compartments are fixed to the corresponding upper compartments at a location and each lower compartment having a respective diameter with respect to the upper compartment such that said lateral sheet mounted on the outer sides thereof converge toward a line situated below said boat.

6. A boat as claimed in claim 1 wherein said keel is inflatable.

7. A boat as claimed in claim 1 wherein said upper compartment said lower compartment and said keel have corresponding diameters such that a channel is formed between the outer surface of said bottom sheet and said lower compartment.

8. A boat as claimed in claim 7 wherein said upper compartments are connected together at said bow and said lower compartments are not connected together such that said channel extends longitudinally along the entire length of said boat so as to have an opening at both the front and rear ends thereof.

9. A boat as claimed in claim 1 wherein said upper compartments are connected together at said bow and said lower compartments are not connected together such that a channel extends longitudinally along the entire length of said boat so as to have an opening at both the front and rear ends thereof.

10. An inflatable boat comprising two legs having first parts that are mutually at least substantially parallel and front parts joined together at the front ends thereof to form part of a bow, each of said leg first parts comprised of an upper compartment and a lower compartment, each compartment being circular or substantially circular in cross section and fixed to one another along a circumferential zone, the upper compartment having a cross section greater than that of the lower compartment;

a rear transom connecting said two legs together and adapted to receive a motor;

a lateral sheet fixed tangentially to said upper and lower compartments on the outer side of the corresponding leg, said upper and lower leg compartments being dimensioned and disposed with respect to each other so that the angle formed by said lateral sheet and the horizontal plane is between 5° and 45°;

a longitudinal keel;

a floor rigid in the transverse direction and engaging the lower face of the upper compartment; and a bottom sheet fixed to said legs at the connection between the upper and lower leg compartments, said keel being interposed between said floor and said bottom sheet, and said keel and said lower leg compartment having dimensions such that said bottom sheet is in contact with the water when the boat is floating thereon.

11. A boat as claimed in claim 10 wherein said leg front parts are comprised of only said upper compartment such that said lower compartments of said legs are not connected together and form a longitudinal channel having openings at both ends of said boat.

12. A boat as claimed in claim 11 in which the angle formed by said lateral sheet and the horizontal plane is between 5° and 25°.

13. A boat according to claim 12 in which the angle formed by said bottom sheet and a horizontal plane is close to 15°.

14. A boat according to claim 11 in which the angle formed by said bottom sheet and a horizontal plane is close to 15°.

15. A boat as claimed in claim 11 wherein each of said two lower compartments are fixed to the corresponding upper compartments at a location and each lower compartment having a respective diameter with respect to the upper compartment such that said lateral sheet mounted on the outer sides thereof converge toward a line situated below said boat.

16. A boat as claimed in claim 11 wherein said keel is inflatable.

* * * * *